US009463634B2

(12) United States Patent
Kaneko et al.

(10) Patent No.: US 9,463,634 B2
(45) Date of Patent: Oct. 11, 2016

(54) LIQUID STORAGE CONTAINER

(71) Applicant: CANON KABUSHIKI KAISHA, Tokyo (JP)

(72) Inventors: Toshiaki Kaneko, Tokyo (JP); Masatoshi Ohira, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/549,456

(22) Filed: Nov. 20, 2014

(65) Prior Publication Data

US 2015/0145934 A1 May 28, 2015

(30) Foreign Application Priority Data

Nov. 26, 2013 (JP) ..... 2013-244405
Apr. 28, 2014 (JP) ..... 2014-092727
Aug. 19, 2014 (JP) ..... 2014-166843

(51) Int. Cl.
*B41J 2/175* (2006.01)

(52) U.S. Cl.
CPC ..... *B41J 2/17563* (2013.01); *B41J 2/17513* (2013.01); *B41J 2/17553* (2013.01)

(58) Field of Classification Search
CPC ..... B41J 2/1433
USPC ..... 347/7, 85–87, 92
See application file for complete search history.

(56) References Cited

U.S. PATENT DOCUMENTS 7,396,117 B2 * 7/2008 Hayashi et al. ..... 347/86
7,938,523 B2 * 5/2011 Aldrich ..... B41J 2/17513 347/84
2004/0080590 A1 * 4/2004 Jung ..... B41J 2/17513 347/87
2006/0227187 A1 * 10/2006 Lui ..... 347/86
2010/0238242 A1 * 9/2010 Rittgers et al. ..... 347/86

FOREIGN PATENT DOCUMENTS

JP 2005-138312 A 6/2005

* cited by examiner

*Primary Examiner* — Lam Nguyen
(74) *Attorney, Agent, or Firm* — Canon U.S.A., Inc. IP Division

(57) ABSTRACT

A liquid storage container, including: a housing; a liquid absorbing member configured to absorb and hold a liquid disposed inside the housing; a filter disposed at a position facing a first surface of the liquid absorbing member; and a liquid ejection substrate disposed at a position facing a surface of the filter opposite to a surface of the filter facing the liquid absorbing member, wherein the liquid absorbing member includes a through hole tubularly penetrating the liquid absorbing member from the first surface to a second surface which is a surface opposite to the first surface, and an opening of the through hole on the first surface side opens at a position facing the filter.

7 Claims, 5 Drawing Sheets

LIQUID STORAGE CONTAINER

BACKGROUND

1. Field of the Invention

The present invention relates to a liquid storage container.

2. Description of the Related Art

A liquid ejecting apparatus exemplified by an inkjet recording apparatus is provided with a liquid storage container and a liquid ejection substrate. The liquid storage container stores a liquid, such as ink, and includes an liquid supply port through which the liquid is supplied to the liquid ejection substrate. An exemplary liquid storage container which includes a liquid absorbing member thereinside for absorbing and holding a liquid has been proposed.

At the time of ejecting the liquid from the liquid ejection substrate, it is desirable to fill an area near an opening surface of an ejection port of the liquid ejection substrate (i.e., at least an area on the liquid ejection substrate side of the liquid storage container) with a liquid. This is because, if air, instead of the liquid, exists in that area, ejection stability may be lowered due to unsuccessful supply of the liquid or other reasons. In a method, the opening surface (i.e., a face surface) of the liquid ejection substrate is filled with a liquid by using, for example, a pump by purging air therefrom. In this method, however, a certain amount of liquid is discharged when the air is purged and, therefore, the liquid in the liquid storage container is consumed by that amount.

In order to address such a problem, Japanese Patent Laid-Open No. 2005-138312 describes a method for reducing an amount of discharged liquid by providing, inside a suction cap, a permeable membrane with which permeation of gas is allowed and permeation of liquid can be controlled by suction force.

SUMMARY

The present disclosure is a liquid storage container, which includes: a housing; a liquid absorbing member configured to absorb and hold a liquid disposed inside the housing; a filter disposed at a position facing a first surface of the liquid absorbing member; and a liquid ejection substrate disposed at a position facing a surface of the filter opposite to a surface of the filter facing the liquid absorbing member, wherein the liquid absorbing member includes a through hole tubularly penetrating the liquid absorbing member from the first surface to a second surface which is a surface opposite to the first surface, and an opening of the through hole on the first surface side opens at a position facing the filter.

Further features of the present invention will become apparent from the following description of exemplary embodiments with reference to the attached drawings.

DESCRIPTION OF THE EMBODIMENTS

According to the study of the applicant, there has been a case in which even the method described in Japanese Patent Laid-Open No. 2005-138312 had difficulty to sufficiently reduce a discharge of a liquid.

Then, the present disclosure provides a liquid storage container capable of filling an area on a liquid ejection substrate side with a liquid while consumption of the liquid is reduced.

Hereinafter, an embodiment of the present disclosure will be described with reference to the drawings.

Figure 1:
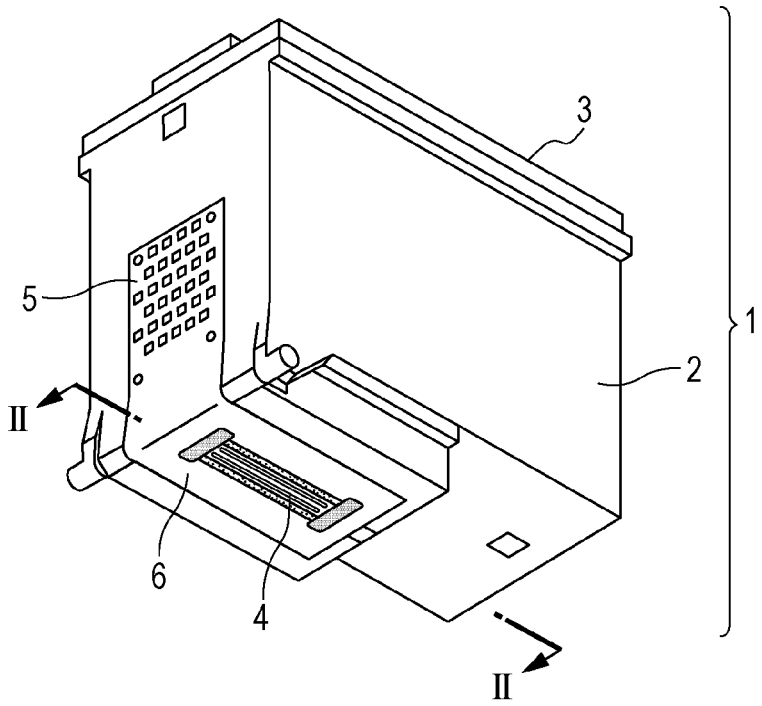
FIG. 1 is a perspective view of a liquid storage container.

FIG. 1 is a perspective view illustrating an exemplary liquid storage container of the present invention. The liquid storage container of FIG. 1 is an ink tank used in an inkjet recording apparatus. The liquid storage container 1 includes a housing 2 which is a case, and a lid member 3. A liquid ejection substrate 4 is attached to a bottom surface of the liquid storage container 1. The liquid ejection substrate 4 is referred also to as a chip and includes wiring, an energy generating element, an ejection port forming member and the like formed on a substrate made of, for example, silicon. A contact section 5 which is an electric contact for receiving driving signals and the like from a recording apparatus (not illustrated) is provided on a side surface of the liquid storage container 1. The contact section 5 is electrically connected to the liquid ejection substrate 4 by an electrical wiring tape 6. A configuration in which the liquid storage container 1 and the liquid ejection substrate 4 are integrated with each other is illustrated in FIG. 1, though the liquid storage container 1 and the liquid ejection substrate 4 may be provided separately and connected to each other via a flow path forming member or other members.

Figure 2A:
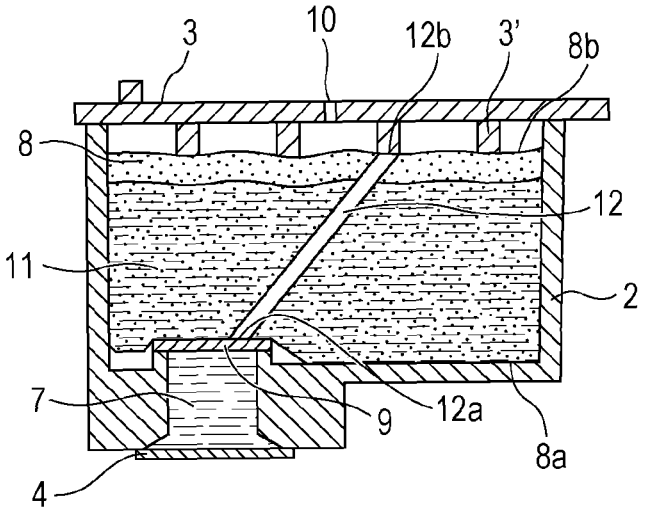
FIGS. 2A and 2B are cross-sectional views of the liquid storage container.
Figure 2B:
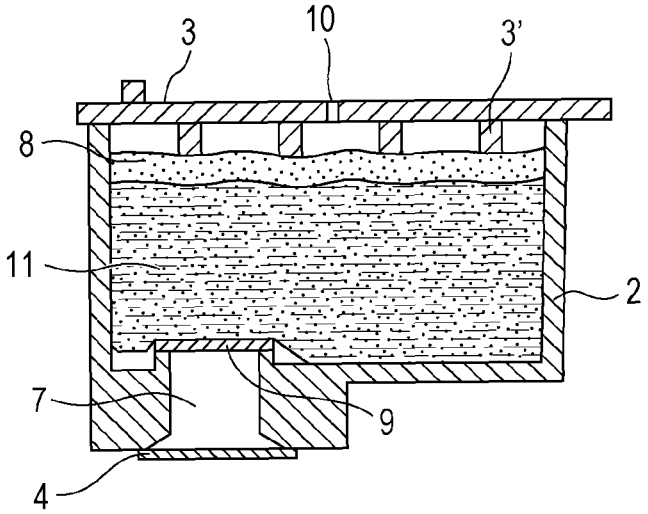

Next, cross-sectional views along line II-II of the liquid storage container 1 illustrated in FIG. 1 are provided in FIGS. 2A and 2B.

As illustrated in FIG. 2A, a liquid supply port 7 is formed in the liquid storage container of the present invention. The liquid in the housing 2 of the liquid storage container is supplied to the liquid ejection substrate 4 through the liquid supply port 7. The liquid supply port 7 is formed on the liquid ejection substrate 4 to protrude from an outer periphery of the housing 2. A liquid absorbing member 8 which absorbs and holds the liquid is provided inside the liquid storage container 2, i.e., inside the housing 2. The liquid absorbing member 8 is made of, for example, polypropylene fiber, polyester fiber, or urethane foam.

A filter 9 is formed in an interface between the liquid absorbing member 8 and the liquid supply port 7 in FIG. 2A. The interface between the liquid absorbing member 8 and the liquid supply port 7 is the filter 9. Holes of about 1 μm to about 50 μm in diameter are formed in the filter 9. With the filter 9, the liquid is successfully supplied by negative pressure. In addition, the filter 9 can stop dust and the like from going into the liquid ejection substrate 4 side. The filter 9 is made of, for example, stainless steel.

An upper portion, i.e., the opposite side of the liquid ejection substrate 4 of a space inside the housing 2 of the liquid storage container is closed by the lid member 3. The lid member 3 may be integrated with the housing 2. An air communication port 10 through which the space inside the housing 2 and the ambient air communicate with each other is formed in the lid member 3. The lid member 3 includes projections 3' projecting on the liquid absorbing member 8 side. The projections 3' press the liquid absorbing member 8, whereby the liquid absorbing member 8 is pressed against the filter 9 and is in contact with the filter 9. The liquid absorbing member 8 has high capillary force in an area near an area in contact with the filter 9. Therefore, when the liquid in the liquid storage container is used, the liquid 11 flows into the area of the liquid absorbing member 8 where capillary force is high, i.e., the area near the filter 9, and is supplied to the liquid ejection substrate 4 through the liquid supply port 7 via the filter 9. The method for generating the capillary force is not limited to the pressing by the lid member 3. For example, a plurality of liquid absorbing members may be used and a difference in density therebetween may be used.

When the liquid reaches the liquid supply port 7, if air (i.e., an outlined portion in FIG. 2B) exists in the space inside the liquid supply port 7 as described in FIG. 2B, supply of the liquid 11 to the liquid ejection substrate 4 becomes difficult. Then, operations to purge the air and to fill the space with a liquid are needed. As described above, the liquid is generally sucked from the face surface of the liquid ejection substrate 4 using a tube or a cap connected to a pump and the like, but the liquid is discharged together with air in this method.

Then, in the liquid storage container of the present invention, as illustrated in FIG. 2A, a through hole 12 is formed in the liquid absorbing member 8 to tubularly penetrate the liquid absorbing member 8 from a first surface 8*a* which is a surface facing the liquid supply port 7 of the liquid absorbing member 8 to a second surface 8*b* which is a surface opposite to the first surface 8*a*. "Tubularly penetrating" means that a cavity having a ring cross section (i.e., an annular cross section) is continuously formed from the first surface 8*a* to the second surface 8*b*. For example, even if a simple in-fiber cavity extends continuously from the first surface 8*a* to the second surface 8*b* in the liquid absorbing member, such a cavity extending continuously does not have an annular cross section and is not formed as a tube. The through hole 12 has an opening 12*a* on the first surface 8*a* side and has an opening 12*b* on the second surface 8*b* side, and extends therebetween. The opening 12*a* of the through hole 12 on the first surface 8*a* side opens at the interface between the liquid absorbing member 8 and the liquid supply port 7. The filter 9 is formed at a position facing the first surface 8*a* of the liquid absorbing member 8. It is desirable that the opening 12*a* of the through hole 12 on the first surface 8*a* side is in contact with the filter 9. In a case in which a plurality of through holes 12 are formed, openings 12*a* of some of the through holes 12 on the first surface 8*a* side may be formed at positions facing the filter 9 and opening 12*a* of other through holes 12 on the first surface 8*a* side may be formed at positions not facing the filter 9. "The positions not facing the filter 9" are, for example, positions facing a space formed at a bottom portion of the housing 2 and not facing the filter 9. The liquid ejection substrate 4 is disposed at a position facing a surface of the filter 9 opposite to a surface of the filter 9 facing the liquid absorbing member 8.

A method for filling the liquid supply port of the liquid storage container with a liquid using such a liquid storage container will be described with reference to FIGS. 3A to 3C.

Figure 3A:
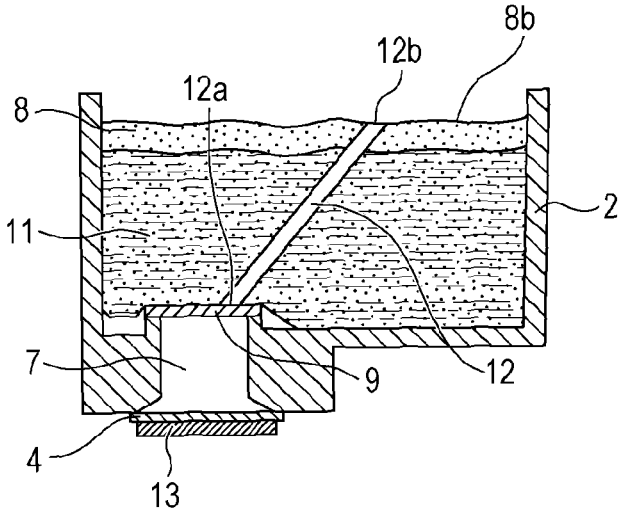
FIGS. 3A to 3C are diagrams illustrating a method for filling the liquid storage container with a liquid.

First, as illustrated in FIG. 3A, a liquid storage container which opens upward is prepared. FIG. 3A illustrates the liquid storage container illustrated in FIG. 2A in a state in which the lid member is not attached. Air exists in the liquid supply port 7. The face surface of the liquid ejection substrate 4 is closed by a sealing member 13. The sealing member 13 may be an elastic body, such as rubber, and a sealing tape which has an adhesive layer. The liquid supply port 7 is also closed when the face surface of the liquid ejection substrate 4 is closed.

Figure 3B:
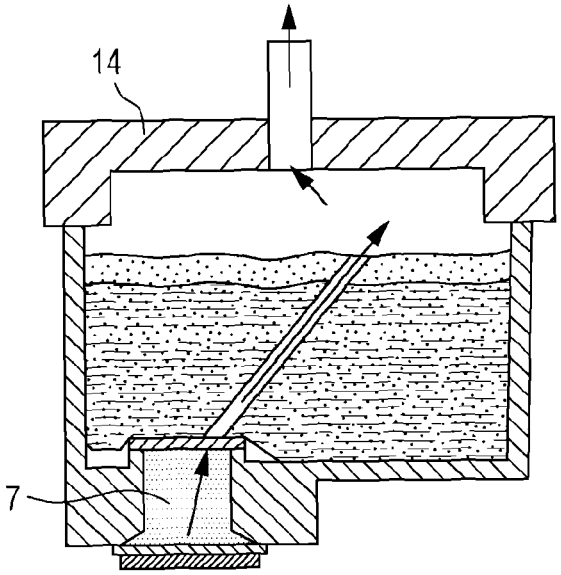

Next, as illustrated in FIG. 3B, air is sucked from the second surface 8*b* side of the liquid absorbing member 8 in a state in which the face surface of the liquid ejection substrate 4 is closed. Air is sucked by, for example, covering the entire upper opening of the liquid storage container with a jig 14 as illustrated in FIG. 3B. Alternatively, air may be sucked from the air communication port 10 in a state in which the lid member 3 is attached, or air may be sucked by depressurizing the entire liquid storage container within a vacuum chamber. When air is sucked, air is moved as illustrated by the arrows. Since the opening 12*a* of the through hole 12 on the first surface 8*a* side opens at the interface between the liquid absorbing member 8 and the liquid supply port 7, the space between the liquid absorbing member 8 and the housing 2 (here, the space inside the liquid supply port) is depressurized via the through hole 12.

Figure 3C:
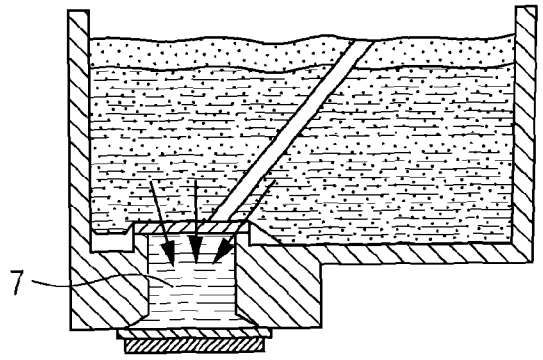

Next, as illustrated in FIG. 3C, space between the liquid absorbing member 8 and the housing 2 (i.e., the space inside the liquid supply port) is pressurized. For example, suction of air is stopped and air is released. When air is released, the liquid absorbed and held by the liquid absorbing member 8 is pressed by atmospheric pressure into the liquid supply port 7 which is the depressurized space, and the liquid supply port 7 is filled with the liquid. In this manner, the liquid supply port 7 which is the area on the liquid ejection substrate side of the liquid storage container can be filled with the liquid while consumption of the liquid is reduced. It is desirable that air is released gradually. If air is released suddenly, air may enter the liquid supply port 7 before the liquid. For example, it is desirable that air is released over one second or more in a state in which a port through which the ambient air is taken is narrowed so that an amount of the ambient air flowing in the liquid storage container is small. Alternatively, it is desirable to take the ambient air in the liquid storage container to such an extent that the pressure inside the liquid storage container does not return to the atmospheric pressure, loosen the depressurized state to some extent, and then release the air again so that the pressure inside the liquid storage container returns to the atmospheric pressure. Alternatively, it is desirable that air is released in a state in which the opening 12*b* on the second surface side is closed because flowing in of air through the through hole 12 can be reduced. The method for pressurizing the space between the liquid absorbing member 8 and the housing 2 is not limited to releasing air.

For example, a degree of depressurization may be lowered, or a pressurized state may be established by stopping depressurization.

The through hole 12 may be formed by, for example, piercing the liquid absorbing member 8 with a needle and then extracting therefrom. Alternatively, the through hole 12 may be formed by using a drill and the like, by using laser, or by using a trowel and the like that melts the liquid absorbing member 8 with heat. It is desirable that the through hole 12 extends linearly. The inside of the liquid absorbing member is porous in some cases and, in those cases, a cavity is formed inside the liquid absorbing member. However, the hole formed by the cavity does not penetrate from the first surface 8*a* to the second surface 8*b* linearly even if the hole penetrates from the first surface 8*a* to the second surface 8*b*. Further, such a cavity is generally less than 0.1 mm in size. It is desirable that the through hole 12 of the present invention is equal to or greater than 0.5 mm in diameter in a cross section in a direction perpendicularly crossing an extending direction of the through hole 12.

Further, it is desirable that the diameter of the through hole 12 is equal to or greater than 0.5 mm from the opening 12*a* to the opening 12*b*. By setting the diameter to equal to or greater than 0.5 mm, the through hole 12 is not easily blocked by the liquid and the air inside the liquid supply port can be purged successfully. More preferably, the diameter is equal to or greater than 0.8 mm and, even more preferably, the diameter is equal to or greater than 1.0 mm. The upper limit is 5.0 mm. By setting the diameter to equal to or smaller than 5.0 mm, re-enter of air at the time of filling the liquid supply port 7 with the liquid can be reduced. It is desirable that the through hole 12 is not filled with the liquid, though may be filled with the liquid. Even in the latter case, the liquid in the through hole 12 is removed when the sucking is performed so that the through hole 12 is not filled with the liquid.

In order to fill the liquid absorbing member with the liquid, a process of piercing the liquid absorbing member with a needle and pouring the liquid may be included. In that case, the process of piercing with a needle at the time of pouring the liquid and the process of piercing with a needle at the time of forming the through hole may be performed collectively. That is, the liquid absorbing member may be pierced with the needle for pouring the liquid and the needle for forming the through hole at the same time.

It is only necessary to form one through hole 12 in one liquid absorbing member 8, though two or more through holes 12 may be formed. However, desirably, the number of the through holes 12 is equal to or smaller than eight and, more desirably, the number of the through holes 12 is equal to or smaller than six. By setting the number of the through holes 12 to equal to or smaller than eight, the liquid can be successfully supplied to the liquid supply port. It is desirable to set the sum of the areas of the openings 12*a* of the through holes is to be smaller than the area of the interface between the liquid absorbing member 8 and the liquid supply port 7. Further, it is desirable to set the sum of the areas of the openings 12*a* of the through holes is equal to or greater than 5% of the area of the interface between the liquid absorbing member 8 and the liquid supply port 7. In a case in which the filter 9 is formed in the interface, it is desirable to set the area of the opening 12*a* of the through hole on the first surface 8*a* side to be smaller than the area of the surface of the filter 9 facing the first surface 8*a*. It is desirable to set the area of the opening 12*a* of the through hole on the first surface 8*a* side to be equal to or greater than 5% of the area of the surface of the filter 9 facing the first surface 8*a*.

Figure 4A:
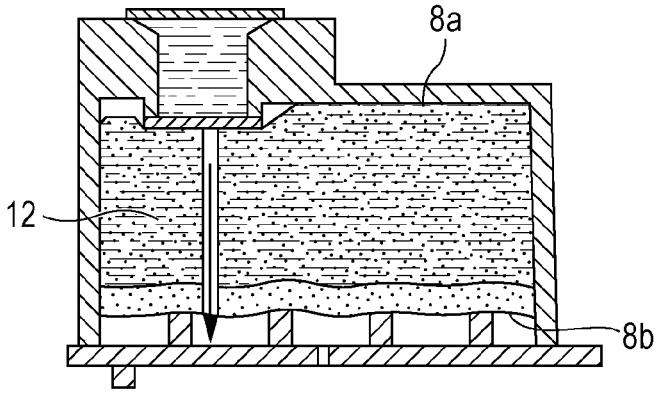
FIGS. 4A and 4B are cross-sectional views of the liquid storage container.
Figure 4B:
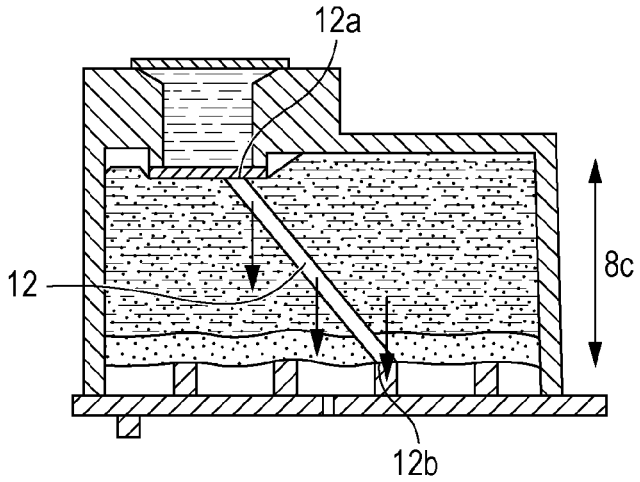
Figure 5A:
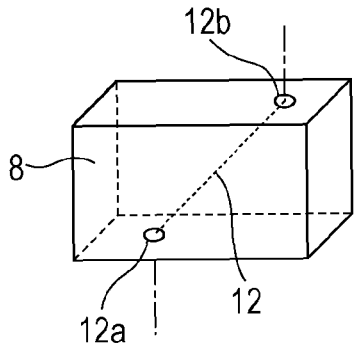
FIGS. 5A to 5E are perspective views of a liquid absorbing member included in the liquid storage container.
Figure 5D:
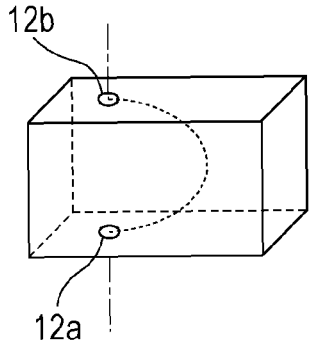
Figure 5B:
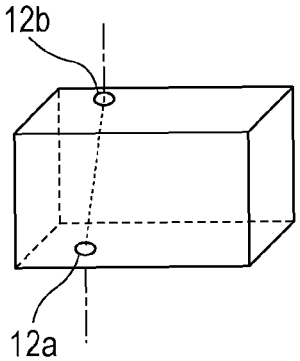
Figure 5E:
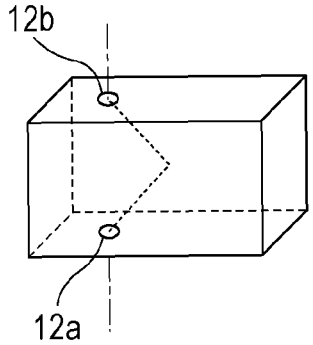
Figure 5C:
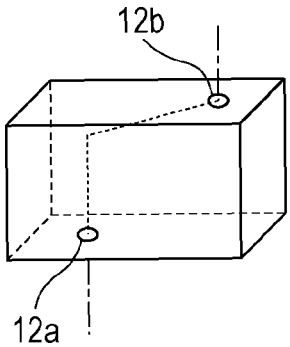

The liquid storage container is used in a state attached to the liquid ejecting apparatus. When the liquid storage container is not attached to the liquid ejecting apparatus, the liquid storage container may be disposed at various angles. For example, as illustrated in FIG. 3A, the liquid storage container may be disposed at an angle with the liquid ejection substrate 4 being disposed in a lower portion but, as illustrated in FIGS. 4A and 4B, the liquid storage container may also be disposed at an angle with the liquid ejection substrate 4 being disposed in an upper portion. In the latter case, there is a possibility that the liquid is discharged on the second surface 8*b* side through the through hole 12. In FIG. 4A, the through hole 12 extends vertically with respect to the first surface 8*a*. In contrast to this, as illustrated in FIG. 4B, it is desirable that the through hole 12 extends in an inclined manner with respect to the first surface 8*a*. It is also desirable that the through hole 12 extends in an inclined manner with respect to the second surface 8*b*. By making the through hole 12 incline with respect to these surfaces, as illustrated in FIG. 4B, it becomes easy for the liquid flowing along the through hole 12 to be absorbed by the liquid absorbing member and it becomes less easy for the liquid to reach the second surface 8*b* side. In that case, a length of the through hole 12 in its extending direction from the opening 12*a* on the first surface 8*a* side to the opening 12*b* on the second surface 8*b* side is longer than a length 8*c* of the liquid absorbing member in a direction vertical to the first surface 8*a* from the first surface 8*a* to the second surface 8*b*. With such a relationship in length, it is desirable that the liquid is easily absorbed by the liquid absorbing member before it reaches the second surface 8*b*.

Patterns of the through hole 12 formed in the liquid absorbing member 8 are illustrated in FIGS. 5A to 5E. In each of the patterns illustrated in FIGS. 5A, 5B and 5C, the straight line extending in a direction vertical to the first surface 8*a* from the center of the opening 12*a* of the through hole 12 on the first surface 8*a* side does not cross a straight line extending in a direction vertical to the first surface 8*a* from a center of the opening 12*b* of the through hole 12 on the second surface 8*b* side. With this configuration, it is desirable that the liquid is easily absorbed by the liquid absorbing member before it reaches the second surface 8*b*. In the patterns illustrated in FIGS. 5D and 5E, although two straight lines are coincident, the through holes 12 are bent from the opening 12*a* to the opening 12*b*. In these patterns, it is also desirable that the liquid is easily absorbed by the liquid absorbing member before it reaches the second surface 8*b*.

In a case in which the liquid storage container is provided with a lid member, it is desirable that at least a part of the opening 12*b* of the through hole 12 on the second surface 8*b* side is closed by the lid member. This configuration can prevent the liquid from being discharged on the second surface 8*b* side, i.e., the lid member side. As illustrated in FIGS. 2A and 2B, in a case in which the lid member 3 is provided with the projections 3', it is desirable to close at least a part of the opening 12*b* of the through hole 12 on the second surface 8*b* side by the projections 3'. It is also desirable to close the entire opening 12*b* by the lid member 3.

EXAMPLES

Hereinafter, the present invention will be described in more detail with reference to Examples.

Example 1

A liquid storage container illustrated in FIG. 3A is prepared. The liquid absorbing member 8 provided in the liquid storage container is made of polypropylene. The liquid absorbing member 8 is pierced with a pin of 2.0 mm in outer diameter and then the pin is extracted so that a through hole 12 tubularly penetrating from the first surface 8*a* to the second surface 8*b* is formed. After the through hole 12 is formed, the liquid absorbing member 8 is filled with a liquid (i.e., ink). The diameter of the through hole 12 in a cross section in a direction perpendicularly crossing an extending direction of the through hole 12 is 1.0 mm and is substantially constant. The face surface of the liquid ejection substrate 4 is made of epoxy resin and is closed by the sealing member 13 made of acrylic resin. The filter 9 is made of stainless steel. The opening 12*a* of the through hole 12 is brought into contact with the filter 9.

In the above-described state, the liquid supply port 7 is observed using the X-ray computed tomography. As a result, the liquid hardly exists in the liquid supply port 7 but air exists instead.

Next, as illustrated in FIG. 3B, in a state in which the face surface is closed by the sealing member 13, air is sucked from the second surface 8*b* side of the liquid absorbing member 8 using the jig 14 which seals the entire upper surface of the opening of the liquid storage container. As a result, inside of the liquid supply port 7 is depressurized to 0.1 atmosphere.

Next, as illustrated in FIG. 3C, suction of air is stopped and air is released gradually over one second or more.

Finally, the lid member 3 is attached as illustrated in FIG. 2A and the opening 12*b* of the through hole 12 is closed by the projections 3' of the lid member 3.

In this manner, the liquid storage container is manufactured. When the liquid supply port 7 of the liquid storage container is observed using the X-ray computed tomography, the liquid supply port 7 is filled with a liquid. In the manufactured liquid storage container, the liquid supply port 7 is filled with a liquid while consumption of liquid is reduced.

Example 2

In contrast to Example 1, a pin of 1.0 mm in outer diameter is used. A diameter of the formed through hole 12 is 0.5 mm. A liquid storage container is manufactured in the same manner as in Example 1 except for those described above.

In this manner, the liquid storage container is manufactured. When the liquid supply port 7 of the liquid storage container is observed using the X-ray computed tomography, the liquid supply port 7 is filled with a liquid. In the manufactured liquid storage container, the liquid supply port 7 is filled with a liquid while consumption of liquid is reduced.

Example 3

In contrast to Example 1, a pin of 0.7 mm in outer diameter is used. A diameter of the formed through hole 12 is 0.3 mm. A liquid storage container is manufactured in the same manner as in Example 1 except for those described above.

In this manner, the liquid storage container is manufactured. When the liquid supply port 7 of the liquid storage container is observed using the X-ray computed tomography, the liquid supply port 7 is filled with a liquid though some air exists. In the manufactured liquid storage container, the liquid supply port 7 is filled with a liquid while consumption of liquid is reduced.

Comparative Example 1

No through hole 12 is formed in Comparative Example 1 while the through hole 12 is formed in Example 1. A liquid storage container is manufactured in the same manner as in Example 1 except for those described above.

When the liquid supply port 7 of the manufactured liquid storage container is observed using the X-ray computed tomography, the liquid hardly existed in the liquid supply port 7, but air existed instead. This is considered to be because the liquid supply port 7 is not fully able to be depressurized only by the hole of the liquid absorbing member 8.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-244405, filed Nov. 26, 2013, No. 2014-092727, filed Apr. 28, 2014 and No. 2014-166843, filed Aug. 19, 2014, which are hereby incorporated by reference herein in their entirety.

What is claimed is:

1. A liquid storage container comprising:

a housing defining a single receiving space for containing a liquid absorbing member and further defining a liquid supply port below the receiving space for containing the liquid absorbing member;

a liquid absorbing member, having a upper surface side and a bottom surface side, configured to absorb and hold a liquid disposed inside the housing;

a filter disposed contiguously between the bottom surface side of the liquid absorbing member and a top opening portion of the liquid supply port; and a liquid ejection substrate disposed at a bottom opening portion of the liquid supply port, wherein the liquid absorbing member includes a through hole, formed therefrom the liquid absorbing member without utilizing a structurally separate tube member, tubularly penetrating the liquid absorbing member from the upper surface side through to the bottom surface side, such that a bottom opening of the through hole on the bottom surface side opens at a position facing directly above, contiguous and in contact with the filter so that the bottom opening is generally positioned centrally within the filter and not adjacent to an outer perimeter of the filter, and an upper opening is formed on the upper surface side of the liquid absorbing member, wherein the through hole descends downwardly in a declined manner with respect to the upper surface side of the liquid absorbing member and extends upwardly in an inclined manner with respect to the bottom surface side of the liquid absorbing member, such that the upper and bottom openings of the through hole are vertically and laterally offset from each other, wherein the housing consists of the single receiving space configured to store a liquid and the liquid absorbing member and does not include a separate ink chamber adjacent the single receiving space for replenishing liquid into the single receiving space.

2. The liquid storage container according to claim 1, wherein a diameter of the through hole in a cross section in a direction perpendicularly crossing an extending direction of the through hole is equal to or greater than 0.5 mm.

3. The liquid storage container according to claim 1, wherein the through hole extends linearly.

4. The liquid storage container according to claim 1, wherein a length of the through hole in its extending direction from the bottom opening on the bottom surface side to an upper opening formed on the upper surface side of the liquid absorbing member is longer than a depth of the liquid absorbing member measured in a vertically-oriented direction from the upper surface side to the bottom surface side of the liquid absorbing member.

5. The liquid storage container according to claim 1, wherein an area of the opening of the through hole on the bottom surface side is smaller than an area of a surface of the filter facing the bottom surface side of the liquid absorbing member.

6. The liquid storage container according to claim 1, wherein the upper surface of the liquid absorbing member is pressed by a lid member which covers the receiving space for containing the liquid absorbing member.

7. The liquid storage container according to claim 6, wherein at least a part of the opening of the through hole on the upper surface side of the liquid absorbing member is closed by the lid member.

* * * * *